US010912358B2

(12) United States Patent
Scicluna et al.

(10) Patent No.: US 10,912,358 B2
(45) **Date of Patent: *Feb. 9, 2021**

(54) TELESCOPIC SUITCASE HANDLE

(71) Applicant: TUMI, INC., Edison, NJ (US)

(72) Inventors: Paul V. Scicluna, Penndel, PA (US); Peter C. Wu, Sunnyside, NY (US); Victor G. Sanz, Whitehouse Station, NJ (US)

(73) Assignee: TUMI, INC., Edison, NJ (US)

( * ) Notice: Subject to any disclaimer, the term of this patent is extended or adjusted under 35 U.S.C. 154(b) by 392 days.

This patent is subject to a terminal disclaimer.

(21) Appl. No.: 15/900,413

(22) Filed: Feb. 20, 2018

(65) Prior Publication Data

US 2018/0168301 A1 Jun. 21, 2018

Related U.S. Application Data

(63) Continuation of application No. 15/200,568, filed on Jul. 1, 2016, now Pat. No. 9,894,971.

(60) Provisional application No. 62/187,652, filed on Jul. 1, 2015.

(51) Int. Cl.
*A45C 5/14* (2006.01)
*A45C 13/26* (2006.01)

(52) U.S. Cl.
CPC ..... *A45C 5/14* (2013.01); *A45C 13/262* (2013.01); *A45C 2013/267* (2013.01)

(58) Field of Classification Search
CPC ... A45C 5/14; A45C 2013/267; A45C 13/262; Y10T 15/451; Y10T 16/451
USPC ..... 190/115; 16/113.1
See application file for complete search history.

(56) References Cited

U.S. PATENT DOCUMENTS 5,374,073 A 12/1994 Hung-Hsin
5,447,217 A * 9/1995 Chou ..... A45C 13/262 16/113.1
5,499,426 A * 3/1996 Hsieh ..... A45C 13/262 16/113.1
5,526,908 A * 6/1996 Wang ..... A45C 13/262 16/113.1

(Continued)

FOREIGN PATENT DOCUMENTS

CN 2468346 Y 1/2002
CN 2653952 Y 11/2004

(Continued)

OTHER PUBLICATIONS

International Search Report and the Written Opinion of the International Searching Authority from corresponding PCT/US2016/040697 dated Sep. 9, 2016.

*Primary Examiner* — Sue A Weaver
(74) *Attorney, Agent, or Firm* — Lando & Anastasi, LLP

(57) ABSTRACT

A telescopic suitcase handle is provided for including a telescopic handle housing disposed within a suitcase, a lower extendible handle section movably disposed within the telescopic handle housing, and an upper extendible handle section movably disposed within the lower section. A spring loaded bullet disposed within the upper section releasably engages with one of a plurality of openings along the length of the lower section for temporarily holding the upper extendible handle section in place. A spring-loaded protrusion releasably engages with the lower extendible handle section for temporarily holding the lower section in place.

21 Claims, 10 Drawing Sheets

(56) References Cited

U.S. PATENT DOCUMENTS

| | | | | |
|---|---|---|---|---|
| 5,575,362 | A | 11/1996 | Franklin et al. | |
| 5,613,273 | A | 3/1997 | Tsai | |
| 5,642,552 | A | 7/1997 | Wang | |
| 5,655,260 | A * | 8/1997 | Chang | A45C 13/262 16/113.1 |
| 5,743,363 | A | 4/1998 | Rekuc et al. | |
| 5,782,325 | A | 7/1998 | O'Shea et al. | |
| 5,803,214 | A | 9/1998 | Wang | |
| 5,806,143 | A | 9/1998 | Tsai | |
| 5,816,374 | A | 10/1998 | Hsien | |
| 5,909,760 | A | 6/1999 | Tsai | |
| 5,927,451 | A | 7/1999 | Tsai | |
| 6,134,749 | A | 10/2000 | Kuo | |
| 6,186,295 | B1 | 2/2001 | Lin et al. | |
| 6,223,391 | B1 | 5/2001 | Kuo | |
| 6,247,203 | B1 | 6/2001 | Kuo | |
| 6,289,554 | B1 | 9/2001 | Wang | |
| 6,347,432 | B1 | 2/2002 | Kuo | |
| 6,360,400 | B1 | 3/2002 | Chang | |
| 6,454,066 | B1 | 9/2002 | Chen | |
| 7,066,311 | B2 | 6/2006 | O'Shea | |
| 7,082,641 | B1 | 8/2006 | Jung et al. | |
| 7,374,183 | B1 | 5/2008 | Yen-Lung | |
| 8,272,100 | B2 | 9/2012 | Scicluna | |
| 8,359,708 | B2 | 1/2013 | Scicluna | |
| 9,894,971 | B2 * | 2/2018 | Scicluna | A45C 13/262 |
| 2002/0105798 | A1 | 8/2002 | Hill | |
| 2003/0009848 | A1 | 1/2003 | Kuo | |
| 2003/0038007 | A1 | 2/2003 | Han | |
| 2006/0225981 | A1 | 10/2006 | Lin | |
| 2008/0053771 | A1 | 3/2008 | Wu | |
| 2010/0095480 | A1 | 4/2010 | Scicluna | |
| 2011/0239401 | A1 | 10/2011 | Scicluna | |
| 2012/0103740 | A1 | 5/2012 | Moussatche et al. | |
| 2013/0068579 | A1 | 3/2013 | Mathieu et al. | |

FOREIGN PATENT DOCUMENTS

| | | | |
|---|---|---|---|
| DE | 9412060 | U1 | 9/1994 |
| DE | 29518585 | U1 | 1/1996 |
| JP | 2004041474 | A | 2/2004 |

* cited by examiner

TELESCOPIC SUITCASE HANDLE

RELATED APPLICATIONS

This application is a continuation of U.S. patent application Ser. No. 15/200,568, filed on Jul. 1, 2016 (now U.S. Pat. No. 9,894,971), which claims priority to U.S. Provisional Patent Application Ser. No. 62/187,652, filed on Jul. 1, 2015, entitled Telescopic Suitcase Handle by Paul V. Scicluna, Peter C. Wu, and Victor G. Sanz, the disclosures of which are incorporated herein by reference.

FIELD OF THE INVENTION

The disclosed invention relates to a telescopic suitcase handle and locking mechanism, and more particularly to a telescopic handle and locking mechanism for a suitcase in which the release mechanism for the locking mechanism is located on the body of the luggage so as to allow for a greater range of designs for the telescopic handle.

BACKGROUND

Contemporary luggage designs often include wheels and a handle so that a user can more easily roll heavy luggage through an airport or other location with greater ease. Suitcase handles may comprise one or more lengths of rigid tubing that extend upwards from the top of the suitcase and include a handle or grip portion at its top for the user to grip and pull. In this manner, suitcases may be tipped at an angle so that the weight of the suitcase is carried by the wheels, while the upper portion of the suitcase is held at an angle and pulled by the user. Many luggage designers attempt to conceal the handle for such luggage within the body of the luggage during periods of non-use in order to maintain the overall appearance of the luggage and to preserve a regular shape for the luggage so that it can be more easily stacked by users or baggage handlers. Furthermore, such extendable or "telescopic" luggage handles may also include one or more locking mechanisms so that the telescopic handle remains in an inserted position during periods of non-use and may also be held in an extended position during periods of use.

Luggage designers employ several techniques for the design of telescopic luggage handles and locking mechanisms. One common design uses a series of concentric metal or hard plastic tubes, so that the interior tubes may be inserted or withdrawn from the exterior tubes in a telescopic fashion. A typical suitcase handle may include two parallel series of concentric tubes connected at the top by a horizontal handle or gripping portion. The base of both series of concentric tubes may be fastened to the wheel assembly or an internal support structure for the suitcase so that the series of concentric tubes will not be separated from the suitcase when fully extended.

Telescopic suitcase handles may also include locking mechanisms to both maintain the telescopic suitcase handle in the inserted position within the suitcase as well as maintain the telescopic suitcase handle in an extended position outside of the suitcase. Some telescopic suitcase handles provide a button on the top of the handle or gripping portion which controls, through a cable, one or more spring-loaded, retractable bullets within the series of concentric tubes comprising the telescopic handle. When pressed, the button retracts the one or more spring-loaded bullets, from corresponding openings within the external tube within the series of concentric tubes, allowing the user to then reposition the internal tube. Once the internal tube is repositioned, the one or more spring-loaded bullets may be released by releasing the button on the handle or gripping portion, allowing the one or more spring-loaded bullets to slide into a new opening within the external tube, corresponding to the new position of the telescopic handle.

One shortcoming of the above-described telescopic handle design is that it requires internal hardware, such as a cable, to be disposed within and along the length of the series of concentric tubes so that the button at the top of the handle or gripping portion may control the spring-loaded bullet as the internal tubes are repositioned within the external tubes. This configuration precludes designers from using narrow, thin, solid, or substantially open telescopic handle designs that do not have an internal space for accommodating the necessary hardware for the locking mechanism. Examples of this disclosure relate to a telescopic suitcase handle design that seeks to solve this limitation of the prior art by providing a new locking mechanism that is controlled without the need for a button on the handle or gripping portion of the telescopic handle and without the need for a cable or similar hardware located on the interior of an internal tube.

SUMMARY OF THE INVENTION

In one example of the present disclosure, a telescopic suitcase handle may be provided, including a telescopic handle housing disposed within a suitcase, a lower extendible handle section movably disposed within the telescopic handle housing when the telescopic suitcase handle is in a fully inserted position, a spring-loaded protrusion that releasably engages with one of a plurality of openings along the length of the lower extendible handle section for temporarily holding the lower extendible handle section in place with respect to the telescopic handle housing, a button for temporarily disengaging the protrusion from the lower extendible handle section, wherein the button is not located on the telescopic suitcase handle, an upper extendible handle section movably disposed within the lower extendible handle section when the telescopic handle is in a fully inserted position, and a spring loaded bullet disposed within the upper extendible handle section that releasably engages with one of a plurality of openings along the length of the lower extendible handle section for temporarily holding the upper extendible handle section in place with respect to the lower extendible handle section. In some examples, the telescopic suitcase handle may further include a handle portion at the top end of the telescopic suitcase handle, two parallel lengths of the lower extendible handle section, and two parallel lengths of upper extendible handle section. In other examples, the telescopic suitcase handle may further include a recessed handle housing on a suitcase for receiving the handle portion of the telescopic suitcase handle when the telescopic suitcase handle is in a fully inserted position. In such examples, the spring-loaded protrusion may be disposed within the recessed handle housing and the button may be disposed on the recessed handle housing. The upper extendible handle section includes a plug at its lower end, and the spring-loaded bullet may be disposed within the plug. In other examples, the upper extendible handle section may have one or more ornamental cutout sections. In some examples, the telescopic suitcase handle may further include a lower frame member for attaching to the telescopic handle housing and the lower frame member may be attached to either an internal support frame for a suitcase or the hard shell of a suitcase.

In some examples of the telescopic suitcase handle, the openings on the lower extendible handle section and on the upper extendible handle section are configured to allow the telescopic suitcase handle to temporarily lock in at least a fully inserted, partially extended, and fully extended position. In other examples, the spring-loaded bullets may be disengaged by depressing a portion of the spring-loaded bullet that extends beyond the outer surface of the lower extendible handle section. In other examples, spring-loaded bullets have a substantially rounded head, such that the spring-loaded bullets may be disengaged by the surrounding lower extendible handle section, when a user exerts a downward or upward force on the upper extendible handle section and, in some examples, may disengage with an upward or downward force on the upper extendible handle section of greater than or equal to about five pounds. In yet further examples, the spring-loaded bullets have a ramped section at its head, such that the spring-loaded bullets may be disengaged by the surrounding lower extendible handle section, when a user exerts a downward or upward force on the upper extendible handle section and, in some examples, may disengage with an upward or downward force on the upper extendible handle section of greater than or equal to about five pounds.

In some examples of the telescopic suitcase, the spring-loaded protrusions may comprise at least one ramped section having a top surface, and the button has at least one ramped section with a lower surface that is in contact with the top surface of the at least one ramped section on the spring-loaded protrusions, wherein depressing the button causes the at least one ramped section on the button to slide down the at least one ramped section on the spring-loaded protrusions, thereby retracting the spring-loaded protrusions. In some examples, the telescopic suitcase handle also has plurality of openings along the length of the lower extendible handle section for temporarily holding the lower extendible handle section in place with respect to the telescopic handle housing, comprise at least two openings for temporarily holding the lower extendible handle section in a fully inserted or fully extended position, with respect to the telescopic handle housing. In other examples, the plurality of openings along the length of the lower extendible handle section for temporarily holding the upper extendible handle section in place with respect to the lower extendible handle section may comprise at least two openings for temporarily holding the upper extendible handle section in a fully inserted or fully extended position, with respect to the lower extendible handle section.

BRIEF DESCRIPTION OF THE DRAWINGS

Various aspects of at least one example of the present disclosure are discussed below with reference to the accompanying figures. The figures are provided for the purposes of illustration and explanation and are not intended as a definition of the limits of the invention. In the figures.

LIST OF REFERENCE NUMERALS UTILIZED IN THE DRAWINGS

Figure 1A:
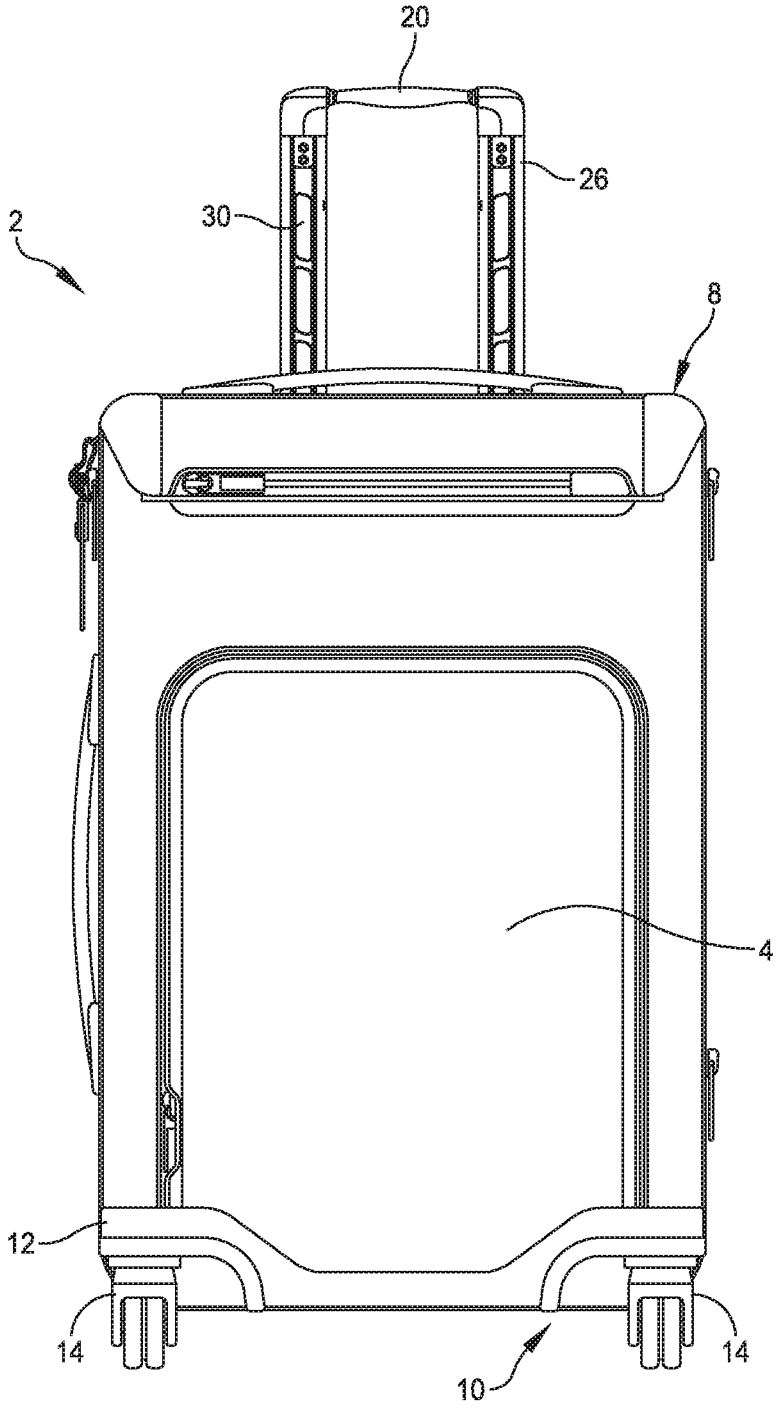
FIG. 1A is a front view of a suitcase with a telescopic suitcase handle according to an example of this disclosure, in a partially extended position.

With regard to reference numerals used, the following numbering is used throughout the description and drawings. Where technical features in the figures or detailed description are followed by these reference numerals, the reference numerals have been included for the sole purpose of increasing the intelligibility of the figures or detailed description. Accordingly, neither the reference numerals nor their absence are intended to have any limiting effect on the scope of any claim elements. In the figures, each identical or nearly identical component that is illustrated in various figures is represented by a like numeral. For purposes of clarity, not every component may be labeled in every figure.

Reference numeral 2 refers to a suitcase.
Reference numeral 4 refers to a front side of a suitcase.
Reference numeral 6 refers to a rear side of a suitcase.
Reference numeral 8 refers to a top side of a suitcase.
Reference numeral 10 refers to a bottom side of a suitcase.
Reference numeral 12 refers to base portion of a suitcase.
Reference numeral 14 refers to rollers, casters, or wheels.
Reference numeral 16 refers to a recessed handle housing.
Reference numeral 18 refers to a telescopic handle.

Reference numeral 20 refers to a handle portion.

Reference numeral 22 refers to one or more handle openings.

Reference numeral 24 refers to a button.

Reference numeral 26 refers to an upper extendible handle section.

Reference numeral 28 refers to a lower extendible handle section.

Reference numeral 30 refers to one or more apertures.

Reference numeral 32 refers to a telescopic handle housing.

Reference numeral 34 refers to a lower frame member.

Reference numeral 36 refers to a plug.

Reference numeral 38 refers to a top cap.

Reference numeral 40 refers to openings.

Reference numeral 42 refers to spring-loaded bullets.

Reference numeral 44 refers to one or more springs.

Reference numeral 46 refers to an opening.

Reference numeral 48 refers to one or more spring-loaded bolts.

Reference numeral 50 refers to one or more springs.

Reference numeral 54 refers to one or more openings.

Reference numeral 56 refers to one or more openings.

Reference numeral 58 refers to a plug.

Reference numeral 60 refers to posts.

Reference numeral 62 refers to openings.

DETAILED DESCRIPTION

Reference will now be made in detail to representative examples illustrated in the accompanying drawings. It should be understood that the following descriptions are not intended to limit the examples to one preferred example. To the contrary, it is intended to cover alternatives, modifications, and equivalents as may be included within the spirit and scope of the described examples as defined by the appended claims.

As disclosed herein, the devices and methods presented can be used for a telescopic suitcase handle that provides a new locking mechanism that is controlled without the need for a button on the handle or gripping portion of a telescopic handle and without the need for a cable or similar hardware located along the interior of a telescopic handle.

For the purpose of explanation and illustration, and not limitation, an example of a suitcase with a telescopic handle is shown in FIGS. 1A-1D. As illustrated, the suitcase 2 shown in FIGS. 1A-1D can be of any suitable construction in terms of materials, manner of assembly, and configurations of the parts, including both hard shell luggage and soft luggage. In some examples, a telescopic handle may be used with a wheeled suitcase. The exemplary suitcase 2, as shown in FIGS. 1A-1D, includes a front side 4, and rear side 6, a top side 8, and a bottom side 10. Proximate to bottom side 10, suitcase 2 may include a base portion 12 formed of hard plastic or other suitable material to which rollers, casters, or wheels 14 may be attached. Base portion 12 may be further attached to an internal frame or support structure within suitcase 2. However, in hard shell luggage, base portion 2 may be unnecessary and rollers, casters, or wheels 14 may my attached directly to bottom side 10 where suitcase 2 comprises a hard shell suitcase.

Proximate to top side 8, suitcase 2 also includes a recessed handle housing 16 that is formed of hard plastic material or another suitably rigid material. In some examples, recessed handle housing 16 may be disposed on the top side 8 and adjacent to rear side 6. However, in other examples, recessed handle housing 16 may be disposed anywhere on top side 6, or any other side of suitcase 2, and may preferably be located approximately in the middle of top side 8. Recessed handle housing 16 may comprise any suitable shape for receiving handle portion 20 of telescopic handle 18, when telescopic handle 18 is in a fully-inserted position. Recessed handle housing 16 may also include one or more handle openings 22 for receiving telescopic handle 18 and through which telescopic handle 18 may slide when it is being inserted or retracted into suitcase 2. Recessed handle housing 16, may further include a button 24 that controls the locking mechanism for the telescopic handle 18. However, in other examples, button 24 may be located elsewhere on suitcase 2, so long as button 24 is readily accessible to the user when suitcase 2 is in use. In a preferred example, button 24 is not located on telescopic handle 18.

Figure 1B:
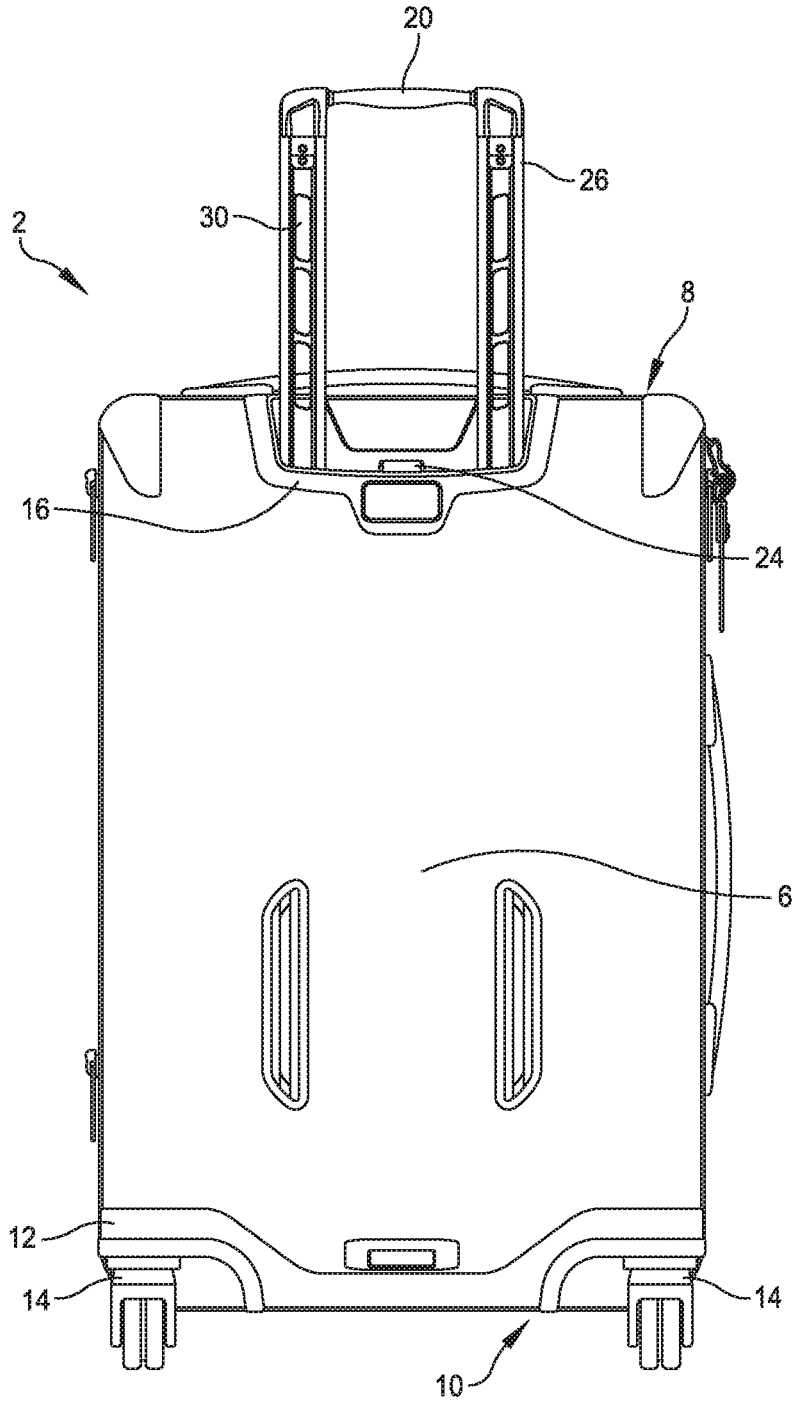
FIG. 1B is a rear view of a suitcase with a telescopic suitcase handle according to an example of this disclosure, in a partially extended position.
Figure 1C:
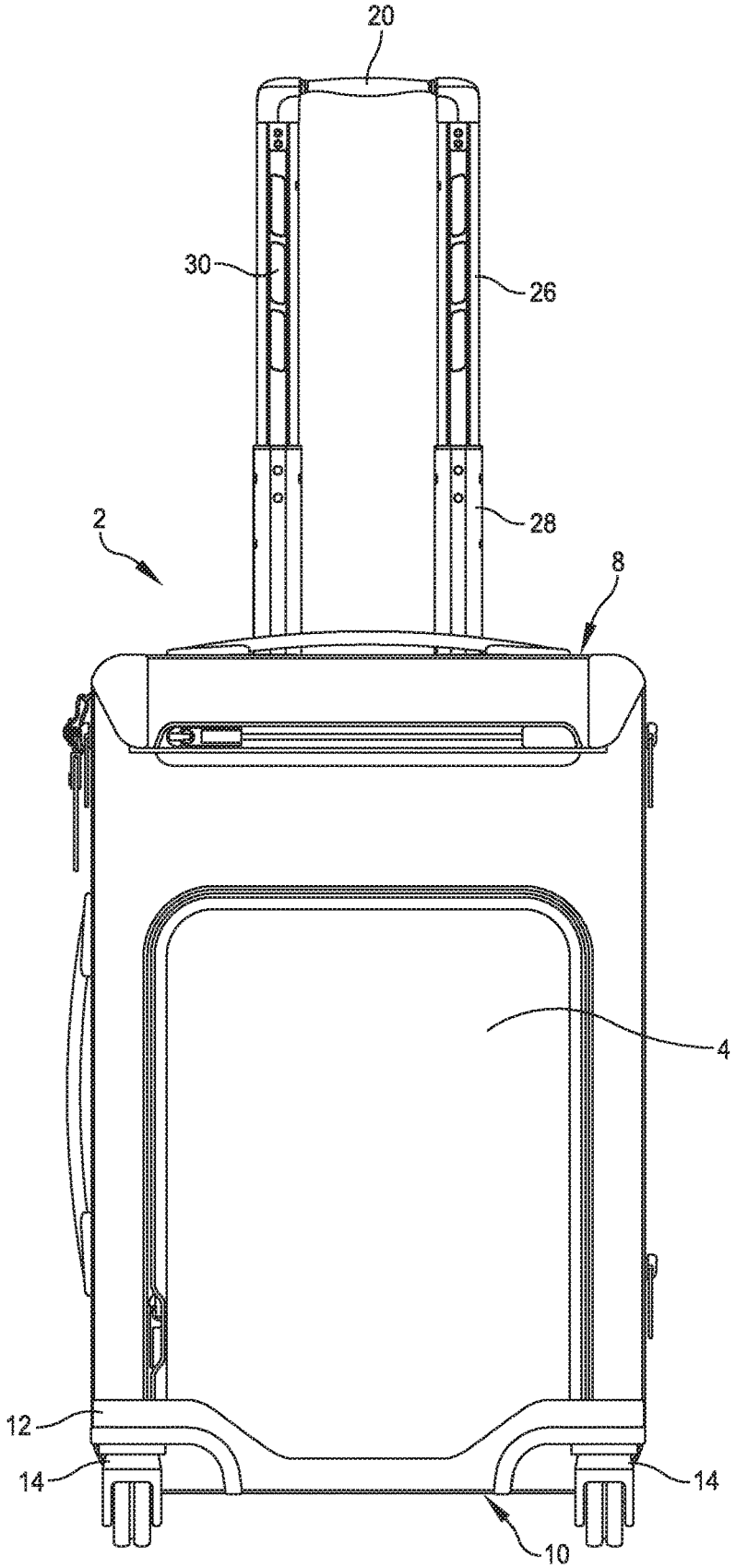
FIG. 1C is a front view of a suitcase with a telescopic suitcase handle according to an example of this disclosure, in a fully extended position.
Figure 1D:
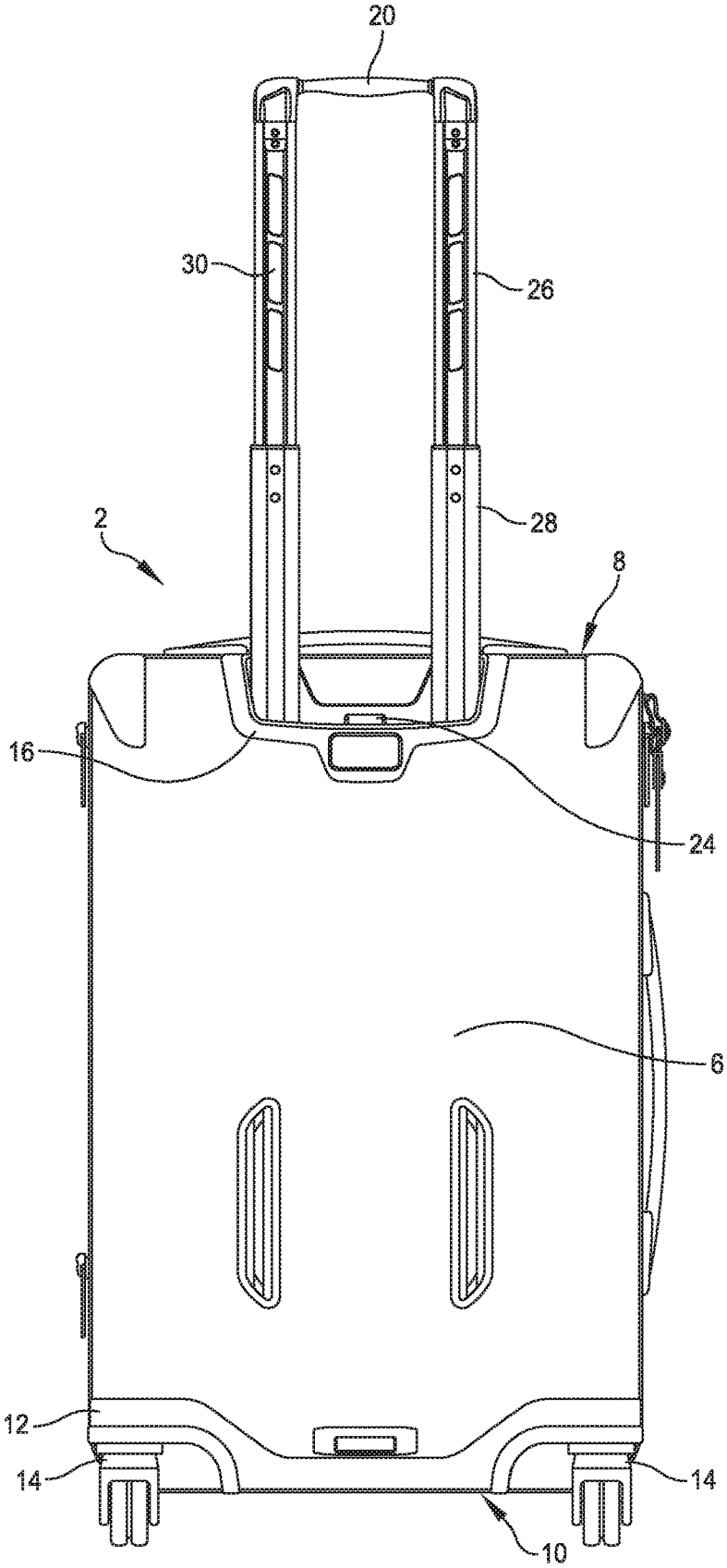
FIG. 1D is a rear view of a suitcase with a telescopic suitcase handle according to an example of this disclosure, in a fully extended position.

FIGS. 1A and 1B show telescopic handle 18 in a partially extended position, while FIGS. 1C and 1D show telescopic handle 18 in a fully extended position. As shown, telescopic handle 18 may comprise two extendible handle sections, including an upper extendible handle section 26 and a lower extendible handle section 28. As shown in FIGS. 1A-1B, in some examples, telescopic handle 18 may comprise two parallel pairs of extendible handle sections that are attached at the top to the two ends of handle portion 20. In other examples, telescopic handle 18 may comprise just one upper extendible handle section 26 and one lower extendible handle section 28 that may be attached to one end or the middle of handle portion 20.

In some examples, handle portion 20 may comprise a horizontal portion that a user may grip with their hand while pulling or pushing suitcase 2. Handle portion 20 may comprise any suitably rigid material, such as hard plastic, ABS plastic, PVC, metal, wood, or other substantially rigid materials as are known to those of ordinary skill in the art. In some examples, handle portion 20 may further include a leather or cloth wrapping around the horizontal gripping portion for the comfort of the user as well as to improve the overall appearance of suitcase 2. As shown, for example, in FIGS. 1A-1D, the horizontal portion of handle portion 20 may be connected to a but end for attaching handle portion 20 to upper extendible handle section 26. The horizontal portion and but ends of handle portion 20 need not be separate components, but may be integrally formed with one another. Handle portion 20 may be attached to upper extendible handle section 26 using any suitable means of attachment as are known to those of ordinary skill in the art, including screwing, welding, soldering, locking, or otherwise fastening. As shown in FIGS. 1A-1D, a tongue projecting from the bottom of the but ends of handle portion 20 may matingly fit into a groove on upper extendible handle section 26, which tongue may be further screwed and/or glued to upper extendible handle section 26.

Upper extendible handle section 26 may comprise a length of rigid material, such as hard plastic, ABS plastic, PVC, metal, wood, or other substantially rigid materials as are known to those of ordinary skill in the art. Unlike other telescopic luggage handles, upper extendible handle section may also comprise one or more apertures 30 and may also be formed of a solid construction with no hollow internal space for accommodating a cable for use with a locking mechanism. Upper extendible handle section 26 may therefore comprise any aesthetically pleasing design and shape and is not confined by the need to accommodate any internal components along its length, such as a cable. At its lower end, upper extendible handle section 26 is movably disposed within lower extendible handle section 28, which has an internal cross-sectional shape and dimensions that substantially match the external cross-sectional shape and dimensions of upper extendible handle section 26. In a preferred example, the internal dimensions of lower extendible handle section 28 may be slightly larger than the external dimensions of upper extendible handle section 26, in order to allow upper extendible handle section 26 to easily slide within lower extendible handle section 28.

As shown, for example, in FIGS. 1C-1D, lower extendible handle section 28 may comprise a length of rigid material, such as hard plastic, ABS plastic, PVC, metal, wood, or other substantially rigid materials as are known to those of ordinary skill in the art. At its lower end, lower extendible handle section 28 may be movably disposed within handle openings 22 in recessed handle housing 16. Handle openings 22 may have an internal shape and diameter that is substantially similar to the external shape and diameters of lower extendible handle section 28. Preferably, the internal dimensions of openings 22 may be slightly larger than the external dimensions lower extendible handle section 28, in order to allow lower extendible handle section 28 to easily slide within handle openings 22. As shown, for example, in FIGS. 1A-1B, in some examples, lower extendible handle section 28 may not protrude from handle openings 22 when telescopic handle 18 is in a fully inserted or partially extended position. However, lower extendible handle section 28 may be visible when telescopic handle 18 is in a fully extended position.

Figure 2:
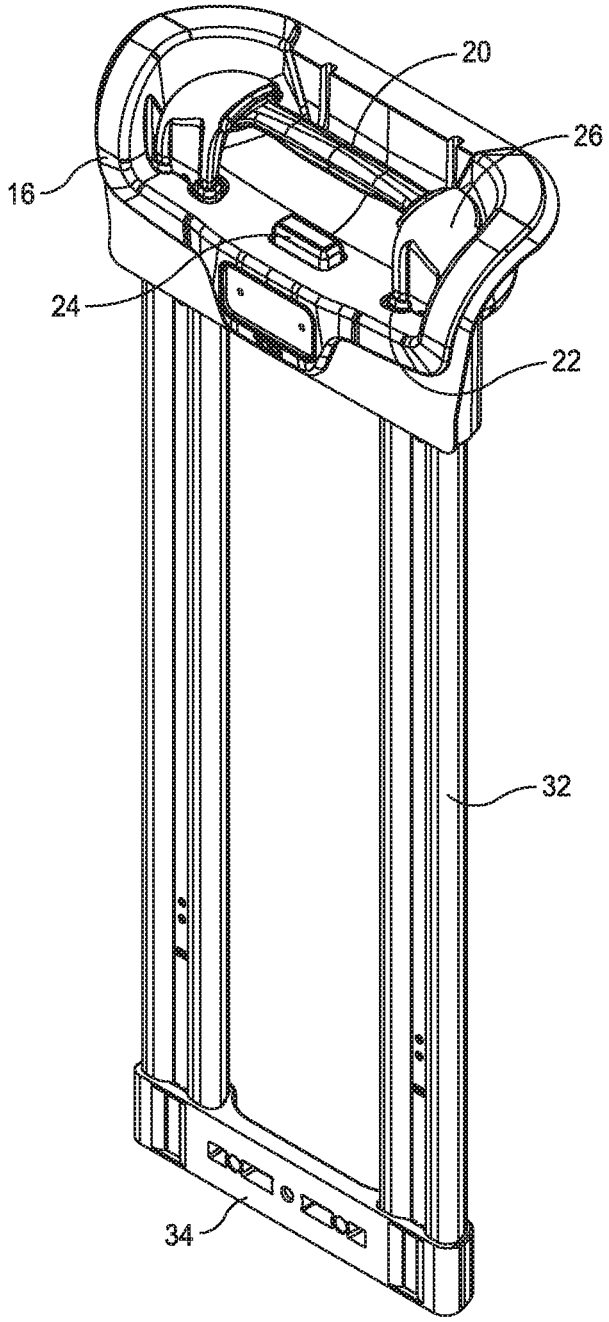
FIG. 2 is front perspective view of a telescopic suitcase handle according to an example of this disclosure, in a fully inserted position.
Figure 3:
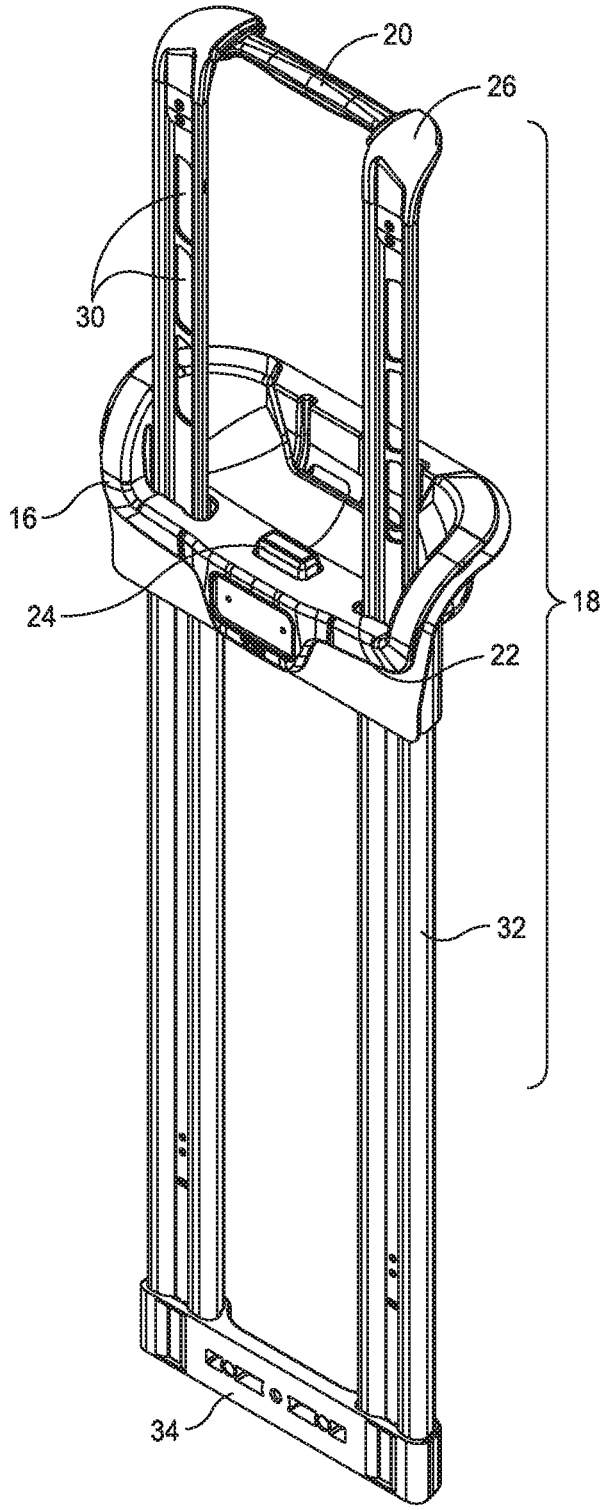
FIG. 3 is front perspective view of a telescopic suitcase handle according to an example of this disclosure, in a partially extended position.
Figure 4:
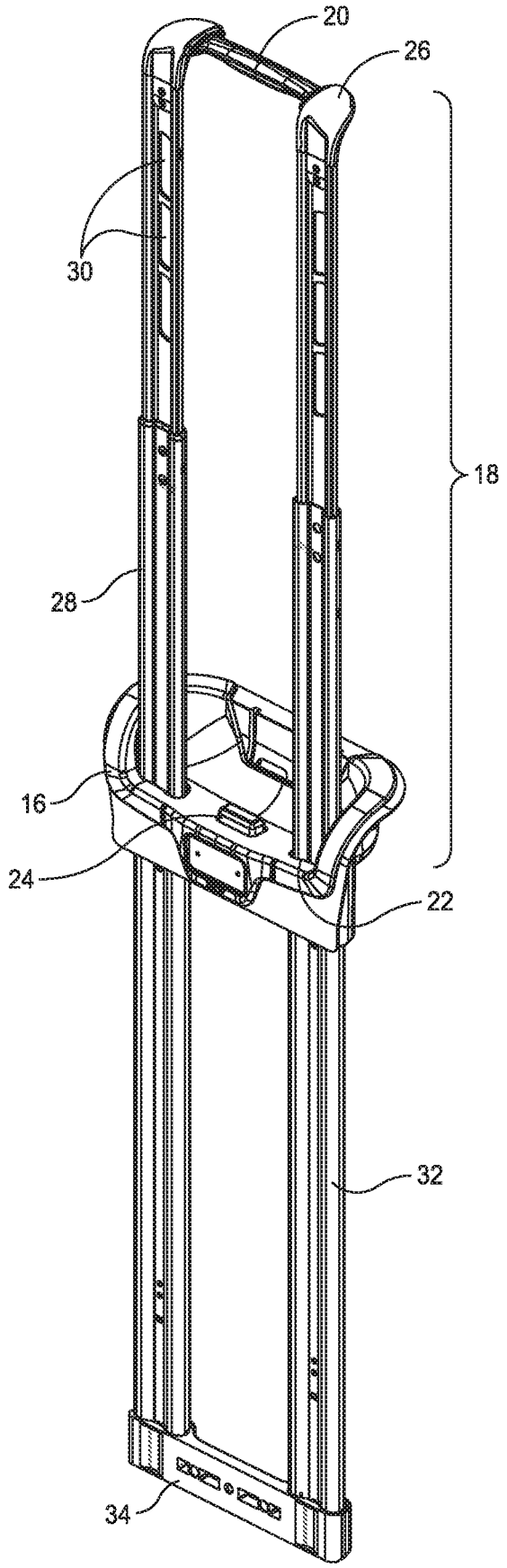
FIG. 4 is a front perspective view of a telescopic suitcase handle according to an example of this disclosure, in a fully extended position.

FIGS. 2-4 are internal views of a telescopic suitcase handle according to an example of this disclosure in fully inserted (FIG. 2), partially extended (FIG. 3) and fully extended (FIG. 4) positions. As shown in FIGS. 2-4, telescopic handle 18 collapses into telescopic handle housing 32 when telescopic handle 18 is in an inserted position. Telescopic handle housing 32 may comprise a stationary tube for receiving upper extendible handle section 26 and lower extendible handle section 28 when telescopic handle 18 is in an inserted position. Thus, when telescopic handle 18 is in a fully inserted position, upper extendible handle section 26 may be disposed within lower extendible handle section 28, which, in turn, may be disposed within telescopic handle housing 32. Telescopic handle housing 32 may comprise a length of rigid tube material, such as hard plastic, ABS plastic, PVC, metal, wood, or other substantially rigid materials as are known to those of ordinary skill in the art. The hollow space within telescopic handle housing 32 may have an internal shape and diameter that is substantially similar to the external shape and diameter of lower extendible handle section 28. Preferably, the internal dimensions of the hollow space within telescopic handle housing 32 may be slightly larger than the external dimensions lower extendible handle section 28, in order to allow lower extendible handle section 28 to easily slide within telescopic handle housing 32.

As further shown in FIGS. 2-4, telescopic handle housing 32 is attached, at its lower end, to a lower frame member 34. Lower frame member 34 may be attached to telescopic handle housing 32 using any suitable means of attachment as are known to those of ordinary skill in the art, including gluing, welding, screwing, soldering, locking, or otherwise fastening. In some examples, telescopic handle housing 32 may be integrally formed with lower frame member 34 such that no fastening is required. Lower frame member 34 may be fastened to an internal frame section of suitcase 2 or base portion 12, or, in the case of a hard shell suitcase, the bottom of suitcase 2, in order to fix the position of both lower frame member 34 as well as telescopic handle housing 32. Lower frame member 34 may be attached to an internal frame section or the bottom of suitcase 2 using any suitable means of attachment as are known to those of ordinary skill in the art, including gluing, welding, screwing, soldering, locking, or otherwise fastening. With the position of the lower frame member 34 and telescopic handle housing 32 are fixed with respect to suitcase 2, telescopic handle 18 may be freely withdrawn from telescopic handle housing 32.

Figure 5A:
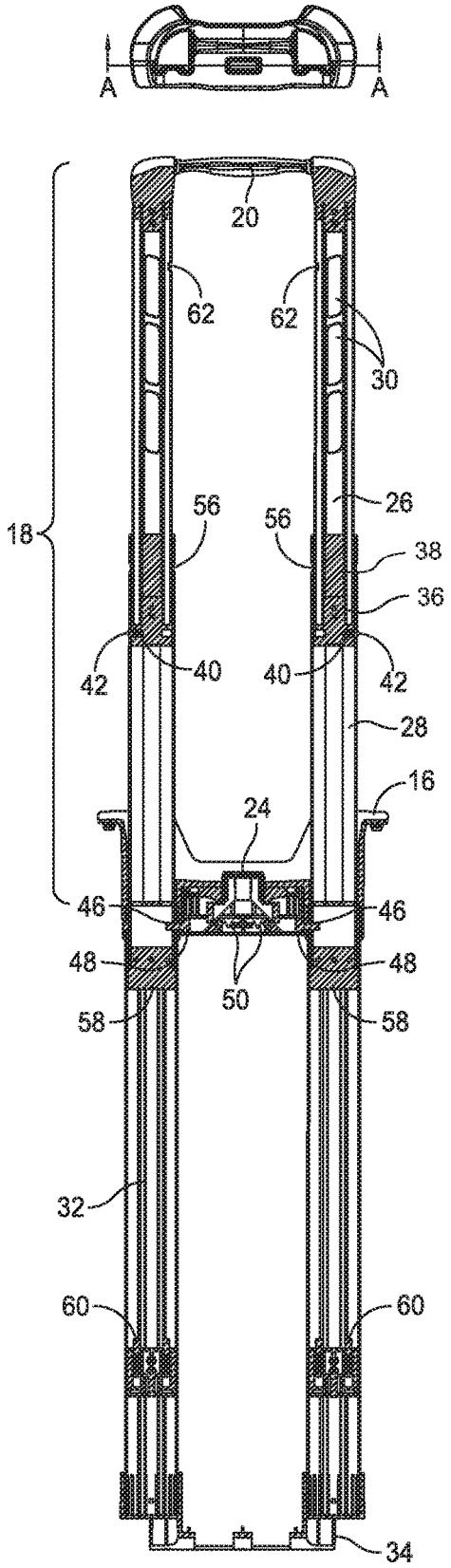
FIG. 5A is a cross-sectional view of a telescopic suitcase handle in a fully extended and locked position, according to an example of this disclosure.
Figure 5B:
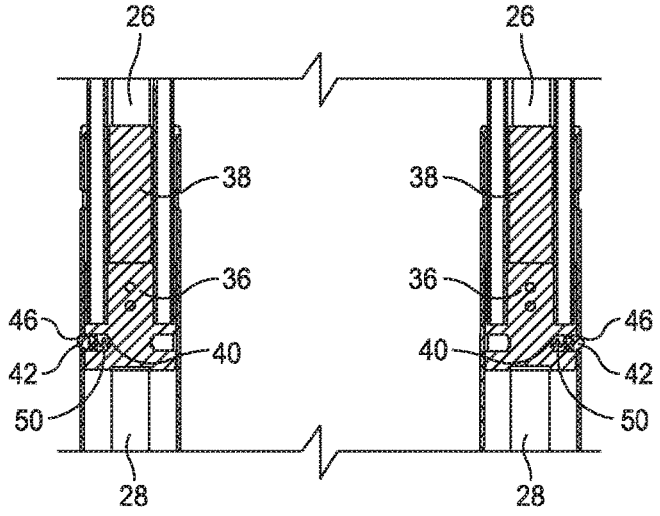
FIG. 5*b* is an enlarged cross-sectional view of the connection between an upper extendible handle section and a lower extendible handle section in a fully extended and locked position, according to an example of this disclosure.
Figure 5C:
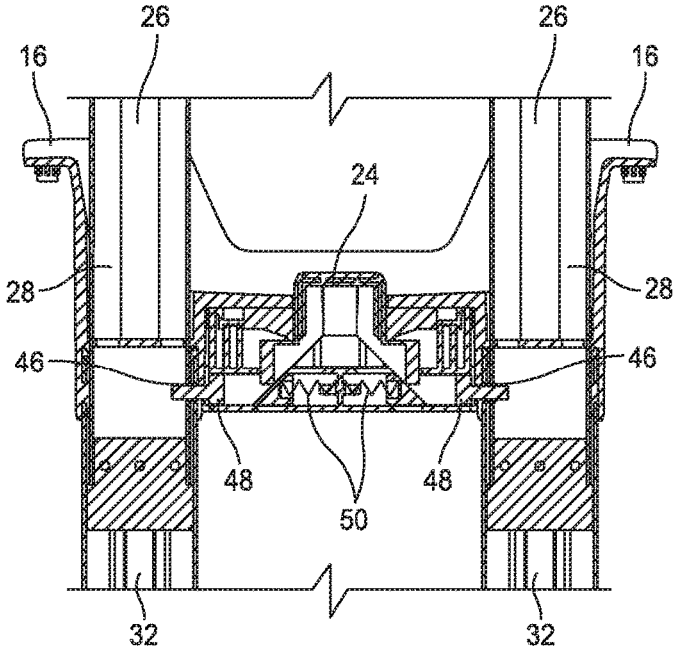
FIG. 5C is an enlarged cross-sectional view of the connection between a recessed handle housing and a lower extendible handle section in a fully extended and locked position, according to an example of this disclosure.
Figure 6A:
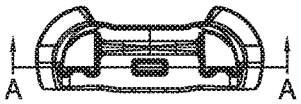
FIG. 6A is a cross-sectional view of a telescopic suitcase handle in a partially extended and locked position, according to an example of this disclosure.
Figure 6A:
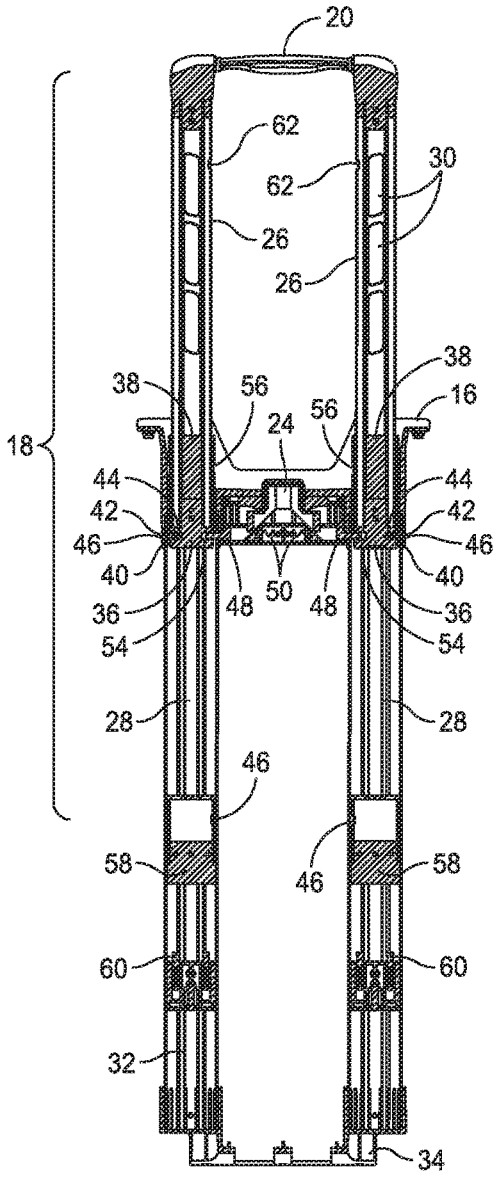

FIGS. 5-7 provide a cross-sectional view of a telescopic handle 18 in both a fully extended position (FIG. 5), a partially extended position (FIG. 6), and a fully inserted position (FIG. 7). These cross sectional views demonstrate the locking mechanisms that control the position of telescopic handle 18 as it is withdrawn or inserted into telescopic handle housing 32. For example, FIGS. 5A-C show a cross sectional view of telescopic handle 18 in a fully extended position. As shown in the cross section, when fully extended, a plug 36 may be disposed at the bottom of upper extendible handle section 26. Plug 36 may comprise any impact-resistant, and durable material, such as a hard rubber or plastic. When telescopic handle 18 is fully extended, plug 36 abuts top cap 38 which may be disposed at the top of lower extendible handle section 28 so as to stop upper extendible handle section 26 from completely exiting lower extendible handle section 28. Top cap 38 may comprise any impact-resistant and durable material, such as a hard rubber or plastic.

As shown, for example, in FIGS. 5A-5C, upper extendible handle section 26 is configured to temporarily lock into place when plug 36 abuts top cap 38 in a fully extended position. For example, plug 36 may include openings 40 that may include one or more spring-loaded bullets 42. Spring loaded-bullet 42 may comprise a hard plastic or metal cylinder that is disposed in a horizontal direction and persistently biased in the outward direction by one or more springs 44. When telescopic handle 18 is in the fully extended position, spring loaded bullet 42 aligns with a corresponding opening 46 on the exterior of lower extendible handle section 28, thus allowing spring-loaded bullet 42 to pass through opening 46, temporarily locking upper extendible handle section 26 in place within lower extendible handle section 28 as shown, for example, in FIG. 5B. Spring-loaded bullet 42 may be released when the user presses spring-loaded bullet 42 back through opening 46 or, alternatively, spring-loaded bullet 42 may have a substantially rounded end that may be pushed back through opening 46 when the user applies sufficient downward or upward force to handle portion 20. In such examples, the rounded end of spring-loaded bullet 42 may contact the outer surface of lower extendible handle section 28, forcing the rounded end of spring-loaded bullet to slip under the outer surface of lower extendible handle section 28, thereby retracting. In an alternative example, bullet 42 may have a ramped or tapered shape at its end that may similarly be pushed back through opening 46 when the user applies sufficient downward or upward force to handle portion 20.

As further shown in FIGS. 5A-C, lower extendible handle section 28 may be held in place within telescopic handle housing 32 by one or more spring-loaded bolts 48. Spring-loaded bolts 48 may comprise a hard plastic or metal cylinder that is disposed in a horizontal direction within recessed handle housing 16 and persistently biased in the outward direction by one or more springs 50, as shown, for example, in FIG. 5C. When lower extendible handle section 28 is in a fully-extended position, spring-loaded bolts 48 will align with one or more corresponding openings 46 on the lower portion of lower extendible handle section 28, through which spring-loaded bolts 48 may pass, thereby locking lower extendible handle section 28 in place within telescopic handle housing 32. In this manner, telescopic handle 18 may be maintained in a fully extended position while a user pushes or pulls suitcase 2.

Figure 6B:
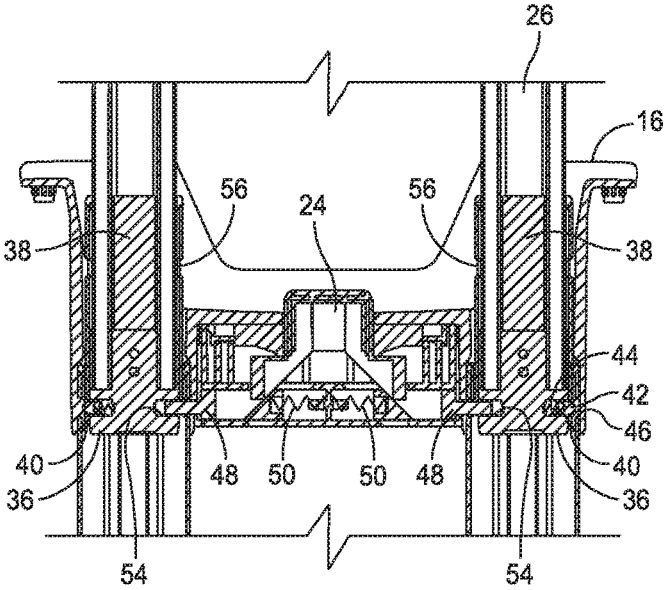
FIG. 6B is an enlarged cross-sectional view of the connection between a recessed handle housing, a lower extendible handle section, and an upper extendible handle section in a partially extended and locked position, according to an example of this disclosure.

To collapse telescopic handle 18 from a fully extended position, as shown in FIGS. 5A-C, to a partially extended position, as shown in FIGS. 6A-B, a user may press button 24, which includes a mechanism for retracting spring-loaded bolts 48. In some examples, button 24, may include a ramp at its bottom end that cooperates with a corresponding ramp on spring-loaded bolts 48 so that the bolts are retracted when button 24 is held in the downward position, as shown, for example, in FIG. 6B. However, any suitable means for retracting spring-loaded bolts 48 may be employed, as is known to those of ordinary skill in the art. With spring-loaded bolts 48 retracted, a user may then apply a downward force to the top of handle portion 20 so that telescopic handle 18 slides downward further into telescopic handle housing 32. As lower extendible handle section 28 passes through recessed handle housing 16, spring-loaded bolts 48 may engage with one or more corresponding openings 54 on the upper portion of lower extendible handle section 28. In this manner, telescopic handle 18 may be maintained in a partially extended position while a user pushes or pulls suitcase 2, as shown, for example, in FIGS. 6A-B.

Figure 7A:
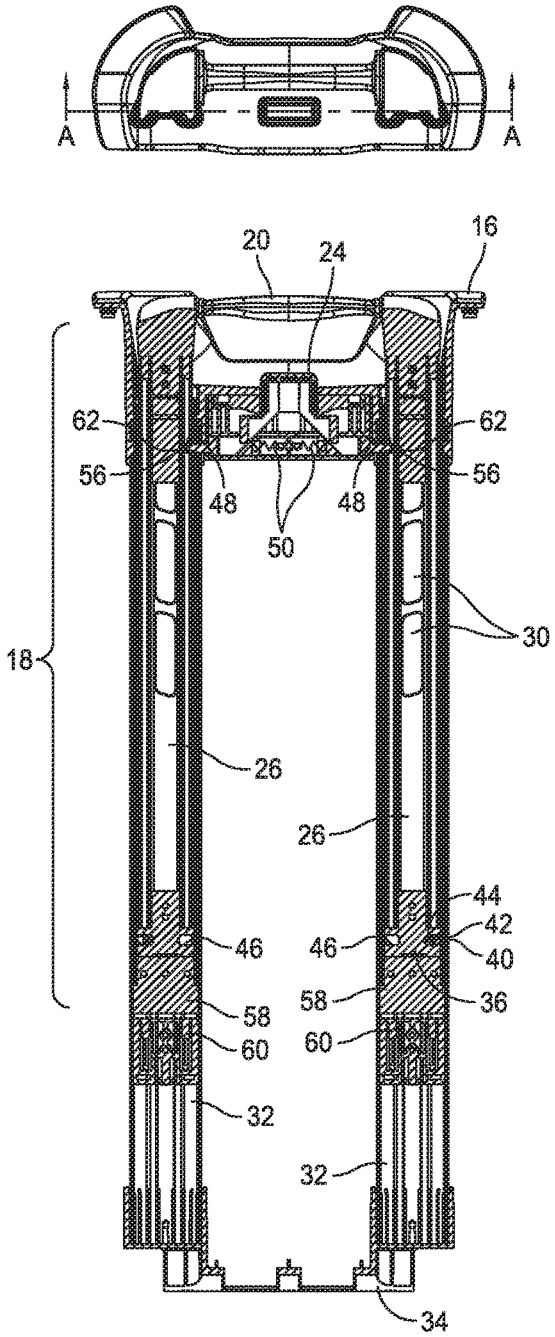
FIG. 7A is a cross-sectional view of a telescopic suitcase handle in a fully inserted and locked position, according to an example of this disclosure.
Figure 7B:
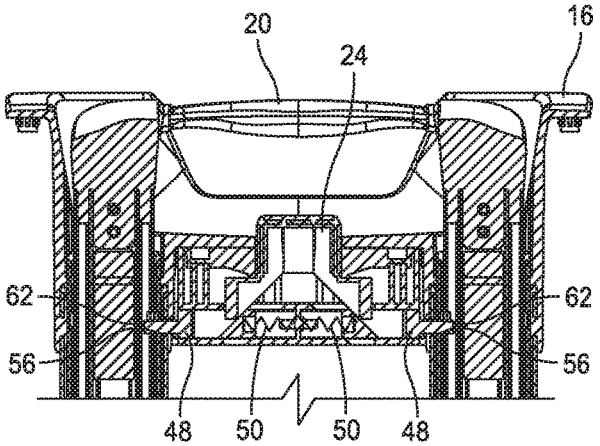
FIG. 7*b* is an enlarged cross-sectional view of the connection between a recessed handle housing, a lower extendible handle section, and an upper extendible handle section in a fully inserted and locked position, according to an example of this disclosure.
Figure 7C:
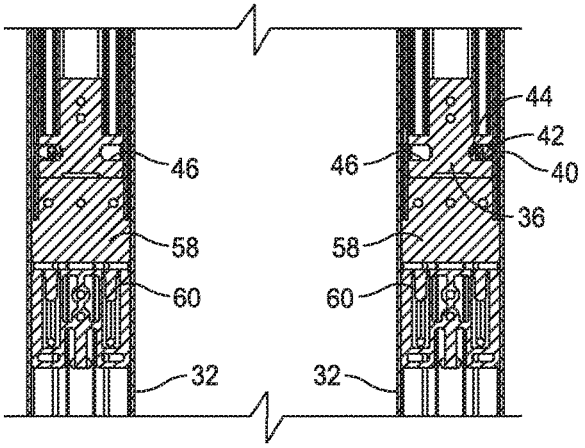
FIG. 7C is an enlarged cross-sectional view of the lower portion of a telescopic suitcase handle in a fully inserted and locked position, according to an example of this disclosure.

To collapse telescopic handle 18 from a partially extended position, as shown in FIGS. 6A-B, to a fully inserted position, as shown in FIGS. 7A-C, the user may press button 24, which includes a mechanism for retracting spring-loaded bolts 48, as previously described above. With spring-loaded bolts 48 again retracted, a user may then apply a downward force to the top of handle portion 20 so that telescopic handle 18 slides downward further into telescopic handle housing 32. As lower extendible handle section 28 passes through recessed handle housing 16, spring-loaded bolts 48 may engage with one or more corresponding openings 56 on the top portion of lower extendible handle section 28. At the same time, plug 58, at the bottom of lower extendible handle section 28, may contact posts 60, which may be disposed within the lower portion of telescopic handle housing 32, thereby halting the downward progress of lower extendible handle section 28. Plug 58 and posts 60 may comprise any impact-resistant, and durable material, such as a hard rubber or plastic. In other examples, posts 60 may be replaced with another impact resistant plug, disposed within the lower portion of telescopic handle housing 32.

Once spring-loaded bolts 48 engage with openings 56 and plug 58 contacts posts 60, the downward progress of lower extendible handle section 28 is halted. The user may then further collapse telescopic handle 18 by exerting sufficient downward force on handle portion 20 to cause spring-loaded bullet 42 to retract within opening 46, so that upper extendible handle section 26 may slide downward within lower extendible handle section 28. As upper extendible handle section 26 slides downward, the lower surface of plug 36 contacts the top surface of plug 58, halting the downward motion of upper extendible handle section 26 as shown, for example, in FIGS. 7A and 7C. At the same time, spring-loaded bolts 48, which are already disposed within openings 56, also may further extend through openings 62 in the upper extendible handle section 26, thus locking both lower extendible handle section 28 and upper extendible handle section 26 in a fully inserted position within telescopic handle housing 32, as shown, for example in FIGS. 7A-C.

To extend telescopic handle 18 back to a partially extended position, the user would perform the above-described method of operation, but in the reverse direction. From a fully inserted position, as shown, for example, in FIGS. 7A-C, a user may press button 24 to disengage spring-loaded bolt 48, as previously described. A user may then supply an upward force on handle portion 20 sufficient to extend upper extendible handle section 26 up through lower extendible handle section 28. When the top surface of plug 36 contacts the lower surface of top cap 38, spring-loaded bullet 42 passes through opening 46, locking upper extendible handle section 26 into place with respect to lower extendible handle section 28. A user may continue to lift telescopic handle 18 upwards until spring-loaded bolts 48 may engage with corresponding openings 54 on the upper portion of lower extendible handle section 28. In this manner, telescopic handle 18 may be maintained in a partially extended position while a user pushes or pulls suitcase 2, as shown, for example, in FIG. 6A.

To extend telescopic handle 18 to a fully extended position, as shown, for example, in FIGS. 5A-C, a user may press button 24 to disengage spring-loaded bolt 48, as previously described. A user may then supply an upward force on handle portion 20 sufficient to extend lower extendible handle section 28 up through telescopic handle housing 32. When spring loaded bolts 48 align with one or more corresponding openings 46 on the lower portion of upper extendible handle section 26, spring-loaded bolts 48 will engage with corresponding openings 46, thereby locking telescopic handle 18 in a fully extended position, as shown, for example, in FIGS. 5A-C.

While the disclosed subject matter is described herein in terms of certain exemplary examples, those skilled in the art will recognize that various modifications and improvements can be made to the disclosed subject matter without departing from the scope thereof. As such, the particular features claimed below and disclosed above can be combined with each other in other manners within the scope of the disclosed subject matter such that the disclosed subject matter should be recognized as also specifically directed to other examples having any other possible permutations and combinations. It will be apparent to those skilled in the art that various modifications and variations can be made in the systems and methods of the disclosed subject matter without departing from the spirit or scope of the disclosed subject matter. Thus, it is intended that the disclosed subject matter include modifications and variations that are within the scope of the appended claims and their equivalents.

What is claimed:

1. A telescopic suitcase handle comprising:

a telescopic handle housing disposed within a suitcase;

a lower extendible handle section movably disposed within the telescopic handle housing;

at least one spring-loaded protrusion disposed proximate an upper end of the telescopic handle housing that releasably engages with each of a first plurality of openings along the length of the lower extendible handle section for temporarily holding the lower extendible handle section in place with respect to the telescopic handle housing;

an upper extendible handle section movably disposed within the lower extendible handle section; and at least one spring-loaded bullet disposed proximate a lower end of the upper extendible handle section that releasably engages with each of a second plurality of openings along the length of the lower extendible handle section for temporarily holding the upper extendible handle section in place with respect to the lower extendible handle section, the at least one spring-loaded bullet configured to engage a first opening of the second plurality of openings when the upper extendible handle section is collapsed within the lower extendible handle section and configured to engage a second opening of the second plurality of openings when the upper extendible handle section is extended away from the lower extendible handle section.

2. The telescopic suitcase handle of claim 1, further comprising a handle portion at the top end of the telescopic suitcase handle.

3. The telescopic suitcase handle of claim 2, further comprising a recessed handle housing on a suitcase for receiving the handle portion of the telescopic suitcase handle when the telescopic suitcase handle is in a fully inserted position.

4. The telescopic suitcase handle of claim 1, further comprising two parallel lengths of the lower extendible handle section.

5. The telescopic suitcase handle of claim 1, further comprising two parallel lengths of upper extendible handle section.

6. The telescopic suitcase handle of claim 1, further comprising a button for temporarily disengaging the at least one spring-loaded protrusion from the lower extendible handle section, wherein the button is not located on the telescopic suitcase handle and is disposed on a recessed handle housing.

7. The telescopic suitcase handle of claim 6, wherein the first and second plurality of openings on the lower extendible handle section and the upper extendible handle section are configured to allow the telescopic suitcase handle to temporarily lock in at least a fully inserted, partially extended, and fully extended position.

8. The telescopic suitcase handle of claim 7, wherein:

the at least one spring-loaded protrusion includes spring-loaded protrusions;

the spring-loaded protrusions further comprise at least one ramped section having a top surface;

the button has at least one ramped section with a lower surface that is in contact with the top surface of the at least one ramped section on the spring-loaded protrusions; and wherein depressing the button causes the at least one ramped section on the button to slide down the at least one ramped section on the spring-loaded protrusions, thereby retracting the spring-loaded protrusions.

9. The telescopic suitcase handle of claim 7, wherein the first plurality of openings along the length of the lower extendible handle section for temporarily holding the lower extendible handle section in place with respect to the telescopic handle housing, comprise at least two openings for temporarily holding the lower extendible handle section in a fully inserted or fully extended position, with respect to the telescopic handle housing.

10. The telescopic suitcase handle of claim 7, wherein the second plurality of openings along the length of the lower extendible handle section for temporarily holding the upper extendible handle section in place with respect to the lower extendible handle section, comprise at least two openings for temporarily holding the upper extendible handle section in a fully inserted or fully extended position, with respect to the lower extendible handle section.

11. The telescopic suitcase handle of claim 7, wherein each of the first plurality of openings is disposed on an inner portion of lower extendible handle section, the inner portion oriented towards a center of the suitcase, and wherein each of the second plurality of openings is disposed on an outer portion of the lower extendible handle section, the outer portion oriented away from the center of the suitcase.

12. The telescopic suitcase handle of claim 1, wherein the upper extendible handle section includes a plug at its lower end, wherein the at least one spring-loaded bullet is disposed within the plug.

13. The telescopic suitcase handle of claim 1, wherein the upper extendible handle section has one or more ornamental cutout sections.

14. The telescopic suitcase handle of claim 1, further comprising a lower frame member for attaching to the telescopic handle housing.

15. The telescopic suitcase handle of claim 14, wherein the lower frame member is attached to either an internal support frame for a suitcase or the hard shell of a suitcase.

16. The telescopic suitcase handle of claim 1, wherein the at least one spring-loaded bullet may further be disengaged by manually depressing a portion of the spring-loaded bullet that extends beyond the outer surface of the lower extendible handle section.

17. The telescopic suitcase handle of claim 1, wherein the at least one spring-loaded bullet has an end shaped such that the at least one spring-loaded bullet is disengaged by the surrounding lower extendible handle section responsive to an upward or downward force exerted on the upper extendible handle section.

18. The telescopic suitcase handle of claim 17, wherein each end of the at least one spring-loaded bullet is substantially ramped or tapered.

19. The telescopic suitcase handle of claim 17, wherein each end of the at least one spring-loaded bullet is rounded.

20. The telescopic suitcase handle of claim 17, wherein the at least one spring-loaded bullet is designed and configured to disengage responsive to an upward or downward force of at least 5 pounds being exerted on the upper extendible handle section.

21. The telescopic suitcase handle of claim 1, wherein the first opening of the first plurality of openings is positioned proximate an upper end of the lower extendible handle section, and wherein the second opening of the first plurality of openings is positioned proximate a lower end of the lower extendible handle section.

* * * * *